US007321094B2

(12) United States Patent
Sakurada

(10) Patent No.: US 7,321,094 B2
(45) Date of Patent: Jan. 22, 2008

(54) ELECTRONIC MUSICAL INSTRUMENT

(75) Inventor: Shinya Sakurada, Hamamatsu (JP)

(73) Assignee: Yamaha Corporation (JP)

( * ) Notice: Subject to any disclaimer, the term of this patent is extended or adjusted under 35 U.S.C. 154(b) by 158 days.

(21) Appl. No.: 10/903,246

(22) Filed: Jul. 30, 2004

(65) Prior Publication Data

US 2005/0076774 A1 Apr. 14, 2005

(30) Foreign Application Priority Data

Jul. 30, 2003 (JP) ..... 2003-203681

(51) Int. Cl.
*G10H 7/00* (2006.01)

(52) U.S. Cl. ..... 84/616; 84/477 R; 84/485 R; 84/603; 84/609; 84/615

(58) Field of Classification Search ..... 84/616, 84/485 R, 477 R, 609
See application file for complete search history.

(56) References Cited

U.S. PATENT DOCUMENTS 4,038,895 A * 8/1977 Clement et al. ..... 84/687
4,463,650 A * 8/1984 Rupert ..... 84/654
4,633,748 A 1/1987 Takashima et al.
4,685,373 A * 8/1987 Novo ..... 84/464 A
4,703,681 A * 11/1987 Okamoto ..... 84/478
4,771,671 A * 9/1988 Hoff, Jr. ..... 84/645
4,915,001 A * 4/1990 Dillard ..... 84/600
4,958,552 A * 9/1990 Minamitaka et al. ..... 84/603
5,018,428 A * 5/1991 Uchiyama et al. ..... 84/616
5,069,105 A * 12/1991 Iba et al. ..... 84/605
5,278,346 A * 1/1994 Yamaguchi ..... 84/609
5,298,678 A * 3/1994 Higashi ..... 84/659
5,504,269 A * 4/1996 Nagahama ..... 84/609
5,554,813 A * 9/1996 Kakishita ..... 84/622
5,770,813 A * 6/1998 Nakamura ..... 84/610

(Continued)

FOREIGN PATENT DOCUMENTS

GB 1393542 2/1972

(Continued)

OTHER PUBLICATIONS

U.S. Appl. No. 10/746,316, filed Dec. 2003, Sakurada.

(Continued)

*Primary Examiner*—Lincoln Donovan
*Assistant Examiner*—Christina Russell
(74) *Attorney, Agent, or Firm*—Rossi, Kimms & McDowell LLP

(57) ABSTRACT

An electronic musical instrument internally stores automatic performance data. The electronic musical instrument reads automatic performance data to perform an automatic performance, while incrementing melody tone pitch data contained in the automatic performance data. The electronic musical instrument obtains a valve state signal from an operated state of a plurality of performance operators. The electronic musical instrument automatically generates pitch data corresponding to a pitch of a voice on the basis of the melody tone pitch data. The electronic musical instrument extracts tone pitch candidates on the basis of the valve state signal, and determines a tone pitch in accordance with the automatically generated pitch data and the tone pitch candidates. The timing at which the determined tone pitch matches the melody tone pitch data is regarded as the timing to increment the melody tone pitch data.

18 Claims, 5 Drawing Sheets

U.S. PATENT DOCUMENTS

| | | | | |
|---|---|---|---|---|
| 5,942,709 | A * | 8/1999 | Szalay | 84/616 |
| 5,986,199 | A * | 11/1999 | Peevers | 84/603 |
| 6,002,080 | A * | 12/1999 | Tanaka | 84/615 |
| 6,011,210 | A | 1/2000 | Haruyama et al. | |
| 6,025,551 | A * | 2/2000 | Munekawa et al. | 84/477 R |
| 6,124,544 | A * | 9/2000 | Alexander et al. | 84/616 |
| 6,211,452 | B1 * | 4/2001 | Haruyama | 84/477 R |
| 6,369,311 | B1 * | 4/2002 | Iwamoto | 84/615 |
| 6,372,973 | B1 * | 4/2002 | Schneider | 84/609 |
| 6,515,211 | B2 * | 2/2003 | Umezawa et al. | 84/477 R |
| 6,555,737 | B2 * | 4/2003 | Miyaki et al. | 84/477 R |
| 6,653,546 | B2 * | 11/2003 | Jameson | 84/735 |
| 6,657,114 | B2 | 12/2003 | Iwamoto | |
| 6,703,549 | B1 * | 3/2004 | Nishimoto et al. | 84/609 |
| 6,816,833 | B1 | 11/2004 | Iwamoto et al. | |
| 6,881,890 | B2 | 4/2005 | Sakurada | |
| 6,911,591 | B2 * | 6/2005 | Akazawa et al. | 84/616 |
| 6,992,245 | B2 | 1/2006 | Kenmochi et al. | |
| 2003/0209131 | A1 * | 11/2003 | Asahi | 84/485 R |

FOREIGN PATENT DOCUMENTS

| | | |
|---|---|---|
| JP | 2003-91285 (A) | 3/2003 |
| WO | WO 00/72303 A1 | 11/2000 |

OTHER PUBLICATIONS

U.S. Appl. No. 10/903,256, filed Jul. 2004, Sakurada.

* cited by examiner

ELECTRONIC MUSICAL INSTRUMENT

BACKGROUND OF THE INVENTION

The present invention relates to an electronic musical instrument obtained by electronically configuring an acoustic musical instrument having a plurality of performance operators for determining a tone pitch of a musical tone to be generated in accordance with a combination of operation of the plurality of performance operators, for example, a wind instrument such as a trumpet, horn, euphonium or tuba.

Conventionally, on the above-described wind instruments, a tone pitch of a musical tone is determined in accordance with two input operations of an input operation on three or four valves and an embouchure input operation. However, it is quite difficult for a rank beginner to successfully produce a musical tone by conducting these two input operations on such wind instruments. In particular, the embouchure input operation is difficult for beginners. Even if the beginner has succeeded in generating a tone, he/she still has a hurdle to overcome before completing a musical piece. More specifically, since a scale (in particular, a series of overtone pitches) is determined in accordance with a combination of the three valve operations, and a tone pitch is determined in accordance with a combination of an embouchure input operation and the valve operations, various different tone pitches can be produced by a combination of valve operations. Therefore, the present applicant has disclosed a performance controller used as an apparatus for practicing such wind instruments (Japanese Laid-Open No. 2003-91285A).

The performance controller disclosed in Japanese Laid-Open No. 2003-91285A has only overcome the difficulty of the embouchure operation and is still susceptible to improvement as a trainer for beginning players. Playing a musical instrument such as a trumpet, horn, euphonium and tuba on which a tone is determined by a fingering combination is difficult because a combination of depressing operations on three or four valves results in a plurality of possible tone pitches. That is, compared to instruments such as keyboard instruments on which an individual tone pitch is determined by an individual key, acquiring skills to play a wind instrument smoothly is more difficult. As a result, beginning players cannot readily play a musical instrument on which a tone is determined by a fingering combination, having difficulty even in finding where to start with in practicing the instrument.

SUMMARY OF THE INVENTION

The present invention solves the above-described problem by providing an electronic musical instrument in which a tone pitch of a musical tone to be generated is determined in accordance with the operation of a combination of a plurality of performance operators, wherein the electronic musical instrument provides a beginner with an assisted performance of a musical piece, offering the beginner the pleasure of performing on a musical instrument, and helping him/her find in practicing the instrument.

It is a feature of the present invention for solving the above-described problem to provide a musical instrument having a plurality of performance operators and an oral input section for inputting a signal containing information on a pitch generated by a mouth, the musical instrument being capable of generating a musical tone in accordance with a combination of operation of the plurality of performance operators and the pitch information contained in the signal input to the oral input section, the musical instrument comprising an ancillary performance section for sequentially outputting first performance data representative of a tone pitch of a musical tone; a pitch data generating section for generating, on the basis of first performance data sequentially output from the ancillary performance section, pitch data representative of a pitch corresponding to pitch information generated by the mouth and designating a tone pitch represented by the first performance data; and a tone pitch determination section for determining a tone pitch of a musical tone that should be generated on the basis of the pitch represented by the generated pitch data and a combination of operation of the plurality of performance operators. In this case, the plurality of performance operators are operated, for example, with a hand.

Due to this feature, the pitch information to be input to the oral input section may be input from tone pitch data contained in automatic performance data or from outside (i.e., from someone other than a player of the musical instrument). This feature enables the player to generate a musical tone only by operating the plurality of performance operators and proceed with the performance. As a result, the musical instrument allows the player to focus on his/her operation of the performance operators, providing the player with an assisted performance of a musical piece and training toward a complete performance on a musical instrument on which a tone is determined by a fingering combination such as a trumpet, horn, euphonium and tuba.

Another feature of the present invention lies in that the musical instrument further includes a performance guiding section for showing a user a combination of the plurality of performance operators that should be operated by use of first performance data output from the ancillary performance section. In this case, for example, the performance guiding section includes a plurality of light emitting devices for showing a user the performance operators that should be operated by light emission of a neighborhood of each of the plurality of performance operators. This feature enables the player to master a combination of operation of the performance operators at every step (at every note) of the performance. Due to this feature, the player becomes capable of generating a musical tone having a right tone pitch only by operating indicated performance operators. Therefore, this feature produces a high degree of effectiveness in practicing a musical instrument.

An additional feature of the present invention lies in that the musical instrument further comprises a performance data update control section for determining whether the tone pitch determined by the tone pitch determination section matches the tone pitch represented by the first performance data output from the ancillary performance section, and controlling, in accordance with the determined result, an update of the performance data output from the ancillary performance section.

Due to this feature, the player is allowed to proceed with the performance when the tone pitch data designated by a combination of performance operators operated by the player matches the tone pitch data contained in performance data transmitted from the ancillary performance section. In other words, the player cannot proceed with the performance when he/she has operated wrong performance operators. Therefore, the musical instrument offers assisted performance only to players having the intention to improve their skills.

A further feature of the present invention lies in that the ancillary performance section has a capability of outputting second performance data that is different from the first performance data in interlocked relation with the first performance data and generating a musical tone corresponding to the second performance data. In this case, for example, the first performance data represents a melody tone, while the second performance data represents an accompaniment tone. This feature allows the player to practice playing a musical piece while listening to the accompaniment tones.

The present invention may be embodied not only as a musical instrument but also as an invention of a method of generating a musical tone.

BRIEF DESCRIPTION OF THE DRAWINGS

The invention will now be described with reference to certain preferred embodiments thereof, wherein.

DESCRIPTION OF THE PREFERRED EMBODIMENT

Figure 1:
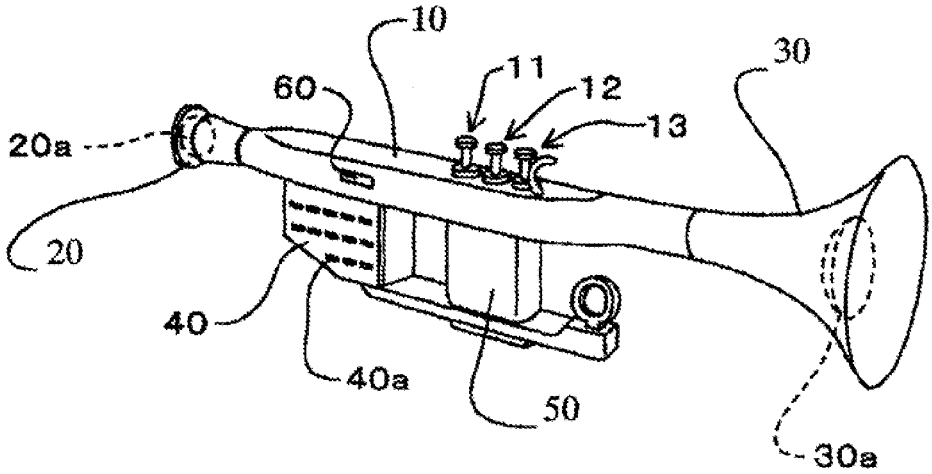
FIG. 1 is an external view of an electronic musical instrument according to an embodiment of the present invention.

FIG. 1 is an external view of an electronic musical instrument according to an embodiment of the present invention. The electronic musical instrument, which is in the shape of a trumpet in the illustrated embodiment, is provided with an oral input section 20 that corresponds to a mouthpiece. The oral input section 20 is provided at the end of a body 10, namely, the end facing a player. Provided at the opposite end of the body 10 is a tone emitting section 30 that corresponds to a bell. At the lower part of the body 10 there are provided an operating section 40 and a grasping section 50. In the midsection of the body 10 there are provided a first valve operator 11, second valve operator 12 and third valve operator 13 which are arranged in this order viewed from the oral input section 20. The first to third valve operators 11 to 13 correspond to piston valves (and keys) of a trumpet, corresponding to "a plurality of performance operators" described in the present invention.

Inside the oral input section 20 there is provided a vibration sensor 20*a* which senses vibrations of air such as a microphone which senses player's voice or a piezoelectric element bonded to a thin plate. Inside the tone emitting section 30 there is provided a speaker 30*a* for emitting musical tones. Further, the operating section 40 is provided with various setting operators 40*a* for switching between modes which will be described later. Inside the body 10 an electronic circuit device for controlling the operation of this musical instrument is housed. In addition, on the side of the body 10 a displayer 60 for displaying various operation modes is provided.

Figure 2:
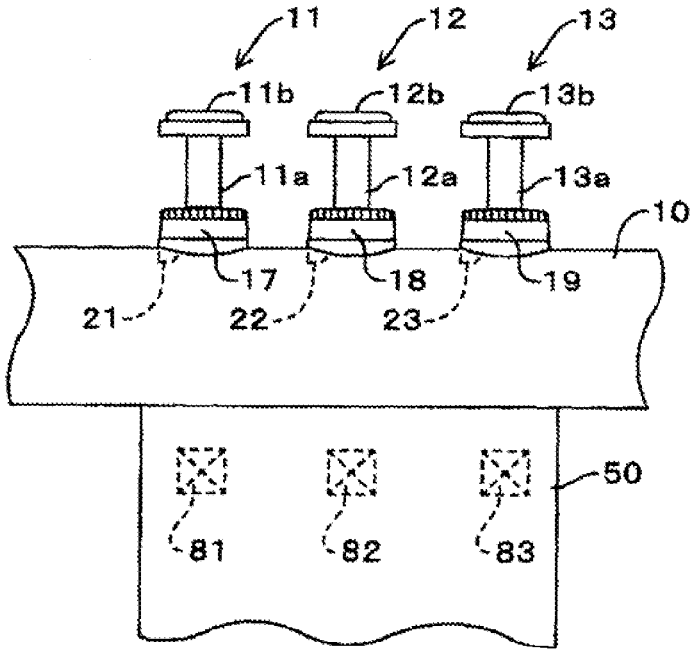
FIG. 2 is a drawing which illustrates the details of valve operators of the electronic musical instrument according to the embodiment of the present invention.

FIG. 2 illustrates the valve operators 11 to 13 in detail. The valve operators 11 to 13 respectively include rods 11*a* to 13*a* extended in the up-and-down direction and disk-shaped operating sections 11*b* to 13*b* that are fixed on the upper end of the rods 11*a* to 13*a* for being pressed and operated by a finger. The rods 11*a* to 13*a* are inserted into the body 10 and grasping section 50 in such a manner that respective rods 11*a* to 13*a* can be raised and lowered. The lower end parts of the rods 11*a* to 13*a* are each urged upward by a spring and stopper mechanism (not illustrated) disposed in the grasping section 50. When the valve operators 11 to 13 are pressed downward, the rods 1*a* to 13*a* are lowered into the body 10 to turn on a switch which is not illustrated. When the downward pressing is released, the rods 11 to 13*a* come to a standstill at the illustrated upper end position to turn off the switch.

At the circumference of the insertion inlets into the body 10 of the rods 11*a* to 13*a*, rings 17 to 19 are fixed, respectively. Under the rings 17 to 19, light-emitting elements 21 to 23 constructed with a light-emitting diode, a lamp, or the like are incorporated in the body 10 so as to correspond to the rings 17 to 19, respectively. The lower part of each of the rings 17 to 19 is formed with a transparent resin. This prevents the light emitted by energization of the light-emitting elements 21 to 23 from leaking through the upper surface of the rings 17 to 19, so that the whole rings 17 to 19 may emit light, each independently.

Figure 3:
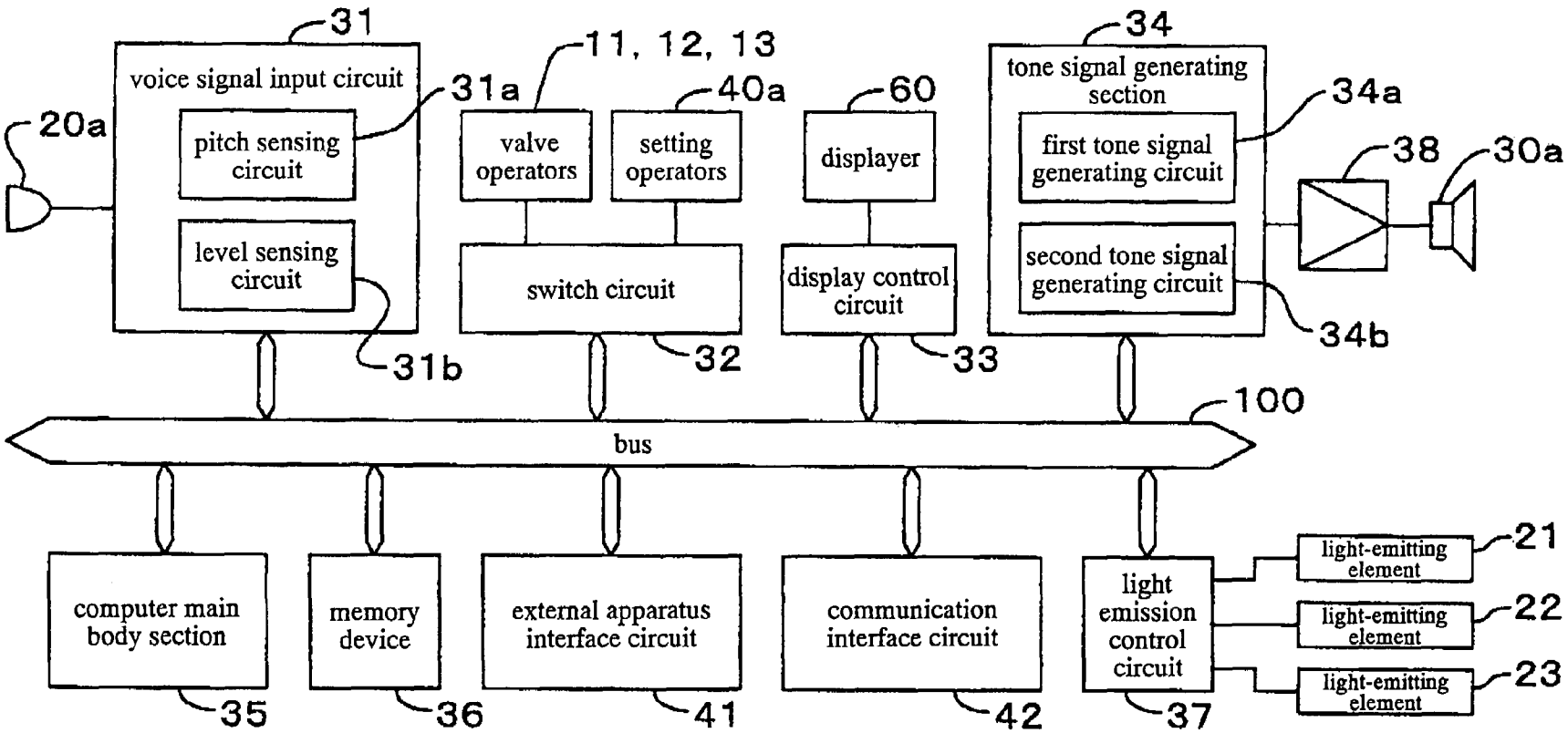
FIG. 3 is a functional block diagram of an electronic circuit device according to the embodiment of the present invention.

FIG. 3 is a functional block diagram of an electronic circuit device according to the embodiment. The electronic circuit device includes a voice signal input circuit 31, a switch circuit 32, a display control circuit 33, a tone signal generating section 34, a computer main body section 35, a memory device 36, and a light emission control circuit 37 that are connected to a bus 100.

The voice signal input circuit 31 includes a pitch sensing circuit 31*a* for sensing the pitch (frequency) of a voice signal that is input from a vibration sensor 20*a*, and a level sensing circuit 31*b* for sensing the tone volume level (amplitude envelope) of the voice signal. The switch circuit 32 has switches that are interlocked with an operation of the first to third valve operators 11 to 13 and the plurality of setting operators 40*a*, and senses the operation of the first to third valve operators 11 to 13 and the setting operators 40*a*. The display control circuit 33 controls the display state of the displayer 60. The tone signal generating section 34 is a circuit which generates tone signals on the basis of tone pitch data, key-on data, and key-off data that is input from the computer main body section 35. The tone signal generating section 34 is configured by a first tone signal generating circuit 34*a* which generates tone signals corresponding to melody tones and a second tone signal generating circuit 34*b* which generates tone signals corresponding to accompaniment tones. These tone signals are output to the speaker 30*a* via an amplifier 38. Here, the tone pitch data represents the frequency (pitch) of the generated musical tone, while the key-on data and key-off data represents the start and end of the generation of a musical tone, respectively.

The computer main body section 35 is composed of a CPU, a ROM, a RAM, a timer, and others, and controls various operations of this electronic musical instrument by execution of a program. The memory device 36 is provided with a recording medium having a small size and a relatively large capacity, such as a memory card, and stores various programs and various performance data. The performance data constitutes automatic performance data of music that stores tone pitch data, key-on data, key-off data, and others in time series. The light emission control circuit 37 controls energization of the light-emitting elements 21, 22 and 23.

Further, an external apparatus interface circuit 41 and a communication interface circuit 42 are also connected to the bus 100. The external apparatus interface circuit 41 communicates with various external music apparatus connected to a connection terminal (not illustrated) so as to enable output and input of various programs and data to and from various external music apparatus. The communication interface circuit 42 communicates with outside via a communication network (for example, the Internet) connected to a connection terminal (not illustrated) so as to enable output and input of various programs and data to and from outside (for example, a server).

Brief description of a method of playing this musical instrument will be given hereafter. A player holds the musical instrument by gripping the grasping section 50 with one hand, and operates to press the first to third valve operators 11 to 13 with the fingers of the other hand. This operation designates the tone pitch of musical tones. In this musical instrument, in the same manner as in a trumpet or the like, a combination of a non-operated state and an operated state of the first to third valve operators 11 to 13 simultaneously designates not one but a plurality of tone pitch candidates. Then, the player operates the first to third valve operators 11 to 13 in a desired combination.

In manual mode, the player generates, toward the oral input section 20, a voice having a frequency that is close to the pitch (the frequency) of the musical tone that the player wishes to generate. The voice in this case may be, for example, a simple one such as "aah" or "uuh" and, in essence, it is sufficient that the voice has a specific frequency (hereinafter, referred to as "voice pitch"). By the generation of this voice, the tone pitch having the closest frequency to the input voice pitch is determined, as a tone pitch of the generated musical tone, from among the plurality of tone pitch candidates designated by the aforesaid operation of the first to third valve operators 11 to 13. Then, according to the determined tone pitch, a musical tone (for example, a trumpet sound) is generated in synchronization with the input voice.

In automatic mode, on the other hand, melody tone pitch data contained in automatic performance data is read out. In accordance with the melody tone pitch data, a combination of the valve operators 11 to 13 that should be operated is displayed through the energization of the light-emitting elements 21 to 23 in corresponding relation with the valve operators 11 to 13. If valve operators corresponding to the energized light-emitting elements among the first to third valve operators 11 to 13 are operated, a tone pitch of a musical tone to be generated is determined on the basis of a plurality of tone pitch candidates designated by this valve operation and melody tone pitch data (pitch data), and the player is allowed to proceed with the performance.

Figure 4:
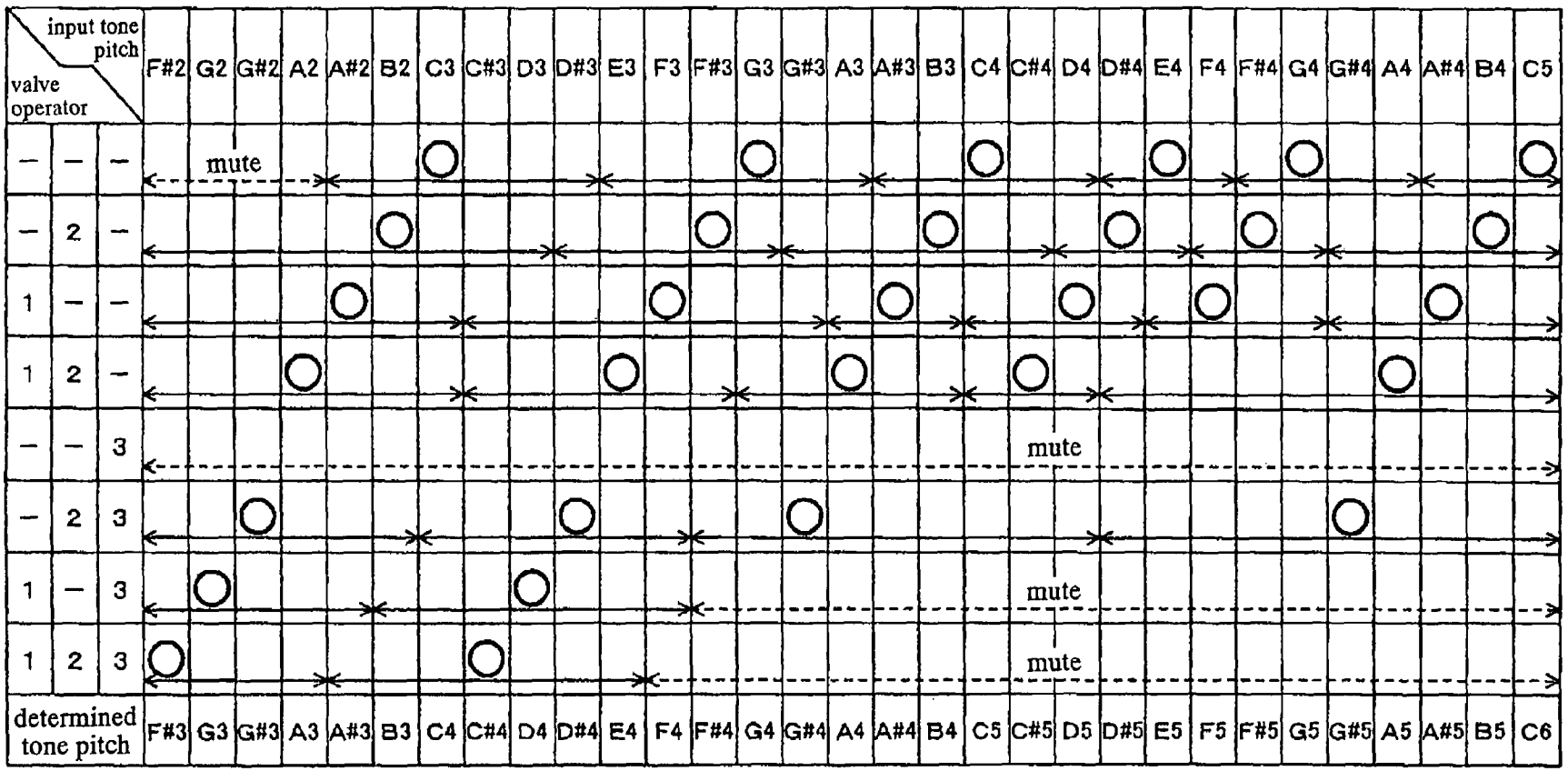
FIG. 4 is a fingering view showing a relationship between tone pitch and fingering according to the embodiment of the present invention.

Next, the determination of a tone pitch will be concretely described with reference to FIG. 4. FIG. 4 is a fingering view showing a relationship between tone pitch and fingering (combinations of an operated state). The left column captioned with "valve operator" in FIG. 4 displays eight combinations of operation of the first to third valve operators 11 to 13 composed of the non-operated state and the operated state of the first to third valve operators 11 to 13 in the vertical direction. In this case, numerals "1", "2", and "3" denote valve operators that should be operated, in respective correspondence with the first, second, and third valve operators 11 to 13, and the symbol "–" denotes a valve operator that should not be operated. On the other hand, the bottom row captioned with "determined tone pitch" in FIG. 4 displays the tone names of the musical tones to be determined for the generation of musical tones, in the lateral direction.

Further, the symbol "○" at an intersection above the "determined tone pitch" and to the right of "valve operator" provides correspondence between the tone pitch of the musical tone to be determined and the combination of the first to third valve operators 11 to 13 that should be operated. Therefore, by a combination of operation of the first to third valve operators 11 to 13, a plurality of tone pitches are designated as tone pitch candidates of the musical tone to be determined. For example, if none of the first to third valve operators 11 to 13 are operated, the tone pitch candidates of the musical tone to be determined will be "C4", "G4", "C5", "E5", "G5" and "C6". If only the second valve operator 12 is operated, the tone pitch candidates will be "B3", "F#4", "B4", "D#5", "F#5", and "B5".

Further, an arrow below the symbol "○" in FIG. 4 displays an allowance range of the shifts of the voice pitch that is input from the oral input section 20. This allowance range corresponds to the frequencies of the tone names displayed in the lateral direction in the top row captioned with "input tone pitch" in FIG. 4. Here, the tone names of the "determined tone pitch" in the bottom row in FIG. 4 are shifted from the tone names of the "input tone pitch" in the top row in FIG. 4 by one octave in order to compensate for the shift of the generated tone pitch range of a trumpet from the voice pitch range of a human voice (male). Further, the denotation "mute" in FIG. 4 means that no musical tones are determined (or generated). Therefore, if for example a voice in a frequency range between "A#2" and "D#3" is input in a state in which none of the first to third valve operators 11 to 13 are operated, a tone pitch of "C4" is determined, while if a voice in a frequency range between "E3" and "A3" is generated in a state in which none of the first to third valve operators 11 to 13 are operated, a tone pitch of "G4" is determined. Here, the allowance ranges of the shift of the frequency of the voice signal can be changed in various ways by an operation of the setting operators 40*a*.

Next, specific operations of the electronic musical instrument according to the embodiment will be described with reference to the functional block diagram of FIG. 5. Here, the computer processing section in this functional block diagram represents the program processing of the computer main body section 35 in functional terms, however, the computer processing section can be configured by a hardware circuit composed of a combination of electronic circuits having capabilities imparted to the blocks shown in FIG. 5. In this embodiment, the player can select between the manual mode and automatic mode by operating a manual/automatic switch 61 that is included in the setting operators 40*a*. When the manual/automatic switch 61 is set at "M" (manual), the electronic musical instrument enters the manual mode. When the manual/automatic switch 61 is set at "A" (automatic), on the other hand, the electronic musical instrument is placed in the automatic mode.

Manual Mode

In the manual mode, the manual/automatic switch 61 set at the "M" side brings an enable terminal of the memory device 36 into low-level, so that the memory device 36, a performance data reading processing section 51, and a fingering conversion processing section 52 are substantially turned into a state of not working, resulting in the operations of later-described automatic performance not being conducted. In addition, since the manual/automatic switch 61 is set at the "M" side, a selector 64, which selects input "A"

when a selector terminal "A" is in high-level, selects input "B" to output a signal in the manual mode. Similarly, a selector 65 selects input "B" to output a signal. Further, respective operated states of the first to third valve operators based on the manual operation by a player are sensed by the switch circuit 32. The switch circuit 32 then outputs a valve state signal. The valve state signal comprises three bits, which correspond to the first to third valve operators, respectively, defining the operated state as "1" and the non-operated state as "0".

In the manual mode, therefore, a valve state signal transmitted from the switch 32 is input to the light emission control circuit 37. The light emission control circuit 37 controls respective energization of the light-emitting elements 21 to 23 corresponding to the valve operators 11 to 13 in accordance with the respective bit contents of the valve state signal. The valve state signal transmitted from the switch 32 is also input to a tone pitch candidate extraction processing section 53. The tone pitch candidate extraction processing section 53 is provided with a tone pitch candidate table 53*a*, which is made, for example, from the fingering view of FIG. 4. In the tone pitch candidate table 53*a*, the combinations of the valve operators ("–, 2, 3" etc.) shown in the left column of FIG. 4 are associated with the three bits of a valve state signal. The tone pitch candidate extraction processing section 53 then outputs, as sets of tone pitch candidate data, sets of tone pitch data on "determined tone pitch" shown in the bottom row corresponding to the symbol "○" provided for designated combinations. The sets of tone pitch candidate data output from the tone pitch candidate extraction processing section 53 are input to a tone pitch determination processing section 54.

On the other hand, a voice pitch of a voice signal that is input from the vibration sensor 20*a* is sensed by the pitch sensing circuit 31*a* and input to the tone pitch determination processing section 54 via the selector 64. The tone pitch determination processing section 54 extracts a set of tone pitch data corresponding to the input voice pitch from among the sets of the input tone pitch candidate data and outputs the extracted tone pitch data to the first tone signal generating circuit 34*a* via the selector 65. On the extraction of the tone pitch data, the aforesaid allowance range set for the input voice pitch may be taken into account or may not be taken into account. Further, a tone volume level of the voice signal input from the vibration sensor 20*a* is sensed by the level sensing circuit 31*b* and input to a sounding control data generation processing section 55. The tone pitch data transmitted from the tone pitch determination processing section 54 is also output to a match sensing circuit 66 and a gate circuit 67 which will be described later, while the tone volume level transmitted from the level sensing circuit 31*b* is also output to a gate circuit 68 and a one-shot circuit 69, however, these circuits do not affect the operations in the manual mode. The sounding control data generation processing section 55 extracts, from data on tone volume level, sounding control data such as a tone volume parameter (velocity) and a tone color parameter of a musical tone to be generated, and outputs the sounding control data to the first tone signal generating circuit 34*a*. The first tone signal generating circuit 34*a* then generates a tone signal on the basis of the tone pitch data determined at the tone pitch determination processing section 54 and the sounding control data to emit a musical tone via the amplifier 38 and speaker 30*a*.

In the manual mode, as described above, a tone pitch of a musical tone to be generated is determined in accordance with the operated state of the valve operators 11 to 13 and the voice pitch transmitted from the vibration sensor 20*a* (oral input section 20), while a tone volume level is determined in accordance with the tone volume level (embouchure) transmitted from the vibration sensor 20*a*, thereby generating a musical tone having thus-determined tone pitch and tone volume. Therefore, the player can conduct manual performance (performance as an ordinary trumpet) on the electronic musical instrument. Further, the light-emitting elements 21 to 23 are energized in accordance with the operated state of the valve operators 11 to 13 in order to indicate an operated valve operator, allowing the player to confirm his/her performance operations.

Automatic Mode

Figure 6:
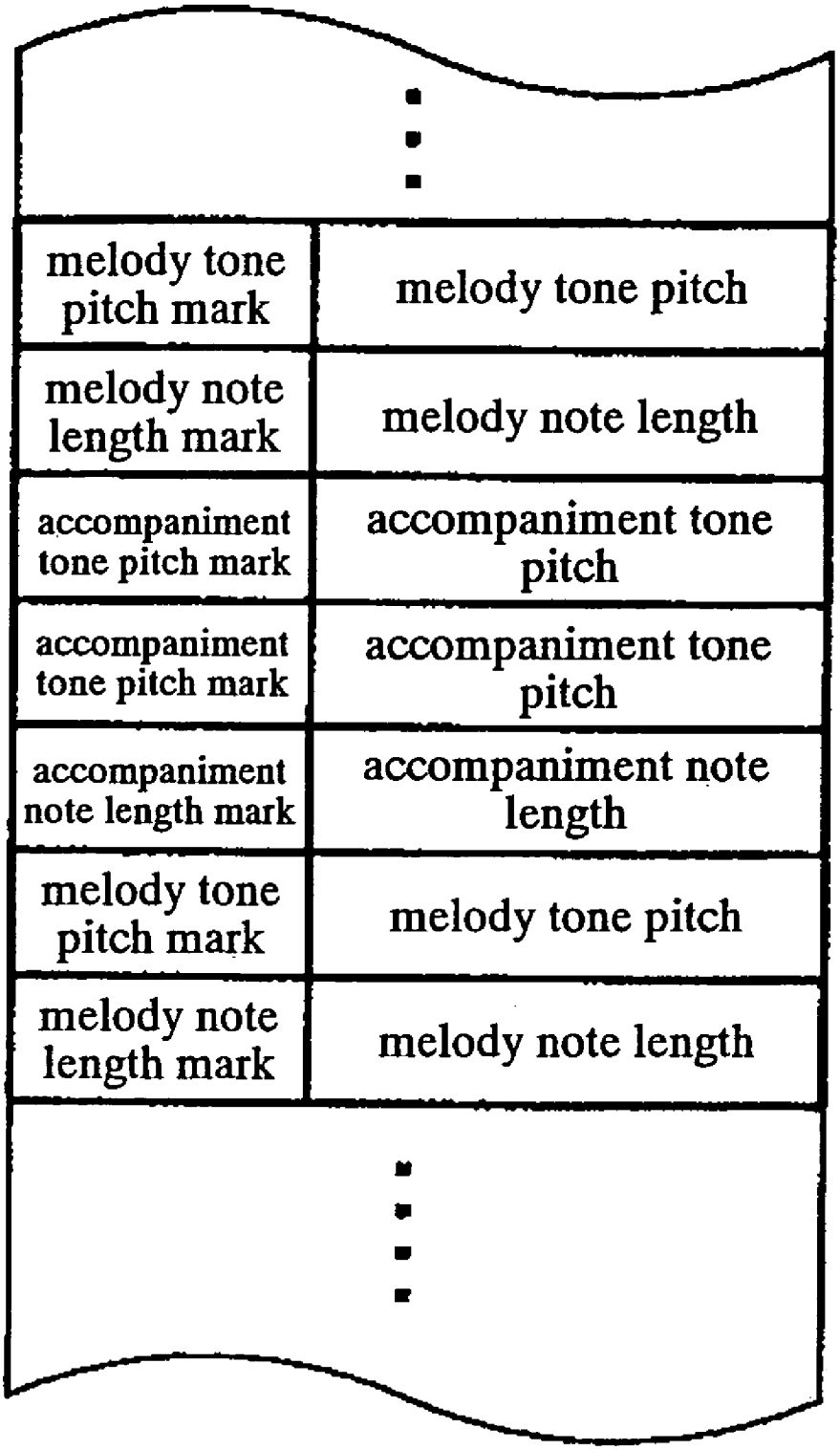
FIG. 6 is a diagram showing a format of automatic performance data according to the embodiment of the present invention.

The automatic mode is a preferred embodiment of the main point of the present invention. When the manual/automatic switch 61 goes into "A" (auto), the selector 64 and selector 65 select input "A" to output a signal. When the manual/automatic switch 61 is in the "A" position, the electronic musical instrument conducts automatic performance-related operations. The performance data reading processing section 51, the fingering conversion processing section 52 and a melody tone pitch mark sensing section 51*a* have capabilities of controlling the reading of automatic performance data from the memory device 36, the reading of melody data from the read-out automatic performance data and the stopping of the reading, the reading of one sequence of accompaniment data and the stopping of the reading, and the generation of valve state signals. As shown in FIG. 6, for example, automatic performance data includes melody tone pitch data representative of the tone pitch of a melody tone, melody note length data representative of the note length of the melody tone, accompaniment tone pitch data representative of the tone pitch of an accompaniment tone, and accompaniment note length data representative of the note length of the accompaniment tone. The above data is provided with a melody tone pitch mark, melody note length mark, accompaniment tone pitch mark and accompaniment note length mark, respectively. The performance data reading processing section 51 comprises memory for automatic performance and a reading section. When the manual/automatic switch 61 is in the "A" position, the performance data reading processing section 51 reads performance data from the memory device 36 and temporarily stores the read data in the memory for automatic performance, while reading melody tone pitch data.

The melody tone pitch data is then output to the fingering conversion processing section 52 and the later-described match sensing circuit 66 and an octave shift (OCTSFT) circuit 71. The fingering conversion processing section 52 automatically generates a valve state signal from the melody tone pitch data on the basis of a fingering table 52*a* and outputs the valve state signal to the light emission control circuit 37. Here, the fingering table 52*a* is equivalent to the inversely converted tone pitch candidate table 53*a*. The valve state signal is generated by converting a "determined tone pitch" (in this case, melody tone pitch data) shown in the bottom row in FIG. 4 into data in which a combination ("–, 2, 3" etc.) of "valve operators" corresponding to a symbol "○" of FIG. 4 is represented with three bits. That is, the valve state signal output from the fingering conversion processing section 52 is automatically generated on the basis of the melody tone pitch data contained in the automatic performance data. The light emission control circuit 37 controls, on the basis of the valve state signal, respective energization of the light-emitting elements 21 to 23 corresponding to the valve operators 11 to 13.

When the melody tone pitch mark sensing section 51*a* senses a melody tone pitch mark of subsequent melody tone pitch data, the melody tone pitch mark sensing section 51*a* outputs a stop signal to the performance data reading processing section 51 to cause the performance data reading processing section 51 to temporarily stop the reading of melody tone pitch data. When the performance data reading processing section 51 receives an increment signal which will be described later, the performance data reading processing section 51 restarts the reading of subsequent melody tone pitch data. More specifically, the performance data reading processing section 51 and the melody tone pitch mark sensing section 51*a* behave such that they process a sequence of data corresponding to a set of melody tone pitch data including accompaniment-related data to increment the memory address of the memory for automatic performance. In other words, the performance data reading processing section 51 precedently reads a set of melody tone pitch data situated one set ahead.

Even if the performance data reading processing section 51 temporarily stops reading melody tone pitch data, by the internal automatic sequence processing, the performance data reading processing section 51 reads accompaniment tone pitch data and accompaniment note length data situated before the subsequent melody tone pitch data and outputs the read data to the second tone signal generating circuit 34*b* to generate a given accompaniment tone in accordance with the accompaniment note length data.

The stop signal output from the melody tone pitch mark sensing section 51*a* is output to the gate circuit 68 as well. The gate circuit 68, which adjusts the width of a gate signal in high-level to control the conduction/non-conduction of the octave shift circuit 71, adjusts the timing at which melody tone pitch data passes through the octave shift circuit 71. More specifically, the gate circuit 68 will suffice in essence as long as it is provided with a one-shot circuit that is triggered by a stop signal output from the melody tone pitch mark sensing section 51*a*. The gate circuit 68 may be designed such that the output of the one-shot circuit allows the octave shift circuit 71 to pass melody tone pitch data newly-read from the performance data reading processing section 51 for a given length of time starting from the emergence of the stop signal.

In a case where the octave shift circuit 71 is allowed to pass the melody tone pitch data only when the output level of the one-shot circuit is in high-level, however, if the output level of the one-shot circuit has been returned to low-level, pitch data (i.e., melody tone pitch data) will not be output to the tone pitch determination processing section 54. The tone pitch determination processing section 54 then stops outputting tone pitch data. This means that unless a player operates the valve operators 11 to 13 appropriately during the output of high-level signal at the gate circuit 68, the later-described determination at the match sensing circuit 66 cannot be made. Therefore, the present embodiment is designed such that data L of the tone volume level transmitted from the level sensing circuit 31*b* is also input to the gate circuit 68. Further, the gate circuit 68 is designed such that the gate circuit 68 in a state of high-level will not bring its output into low-level as long as the data L input to the gate circuit 68 is equal to or above a predetermined tone volume level. Furthermore, the gate circuit 68 is designed such that, even in a case where the gate circuit 68 has put its output into low-level, if newly-input data L has a tone volume level equal to or higher than a predetermined level, the gate circuit 68 outputs a high-level signal again and switches to low-level when a given length of time has elapsed after the data L decreases below the predetermined tone volume level. More specifically, the one-shot circuit incorporated into the gate circuit 68 keeps being re-triggered as long as the data L has a tone volume level equal to or higher than the predetermined level. This re-triggering operation allows the one-shot circuit to switch an output signal from high-level to low-level when a given length of time has elapsed after the data L decreases below the predetermined tone volume level. In this case, therefore, the one-shot circuit is designed to have a not-so-long period of time during which a high-level signal is maintained after a trigger is vanished.

Figure 5:
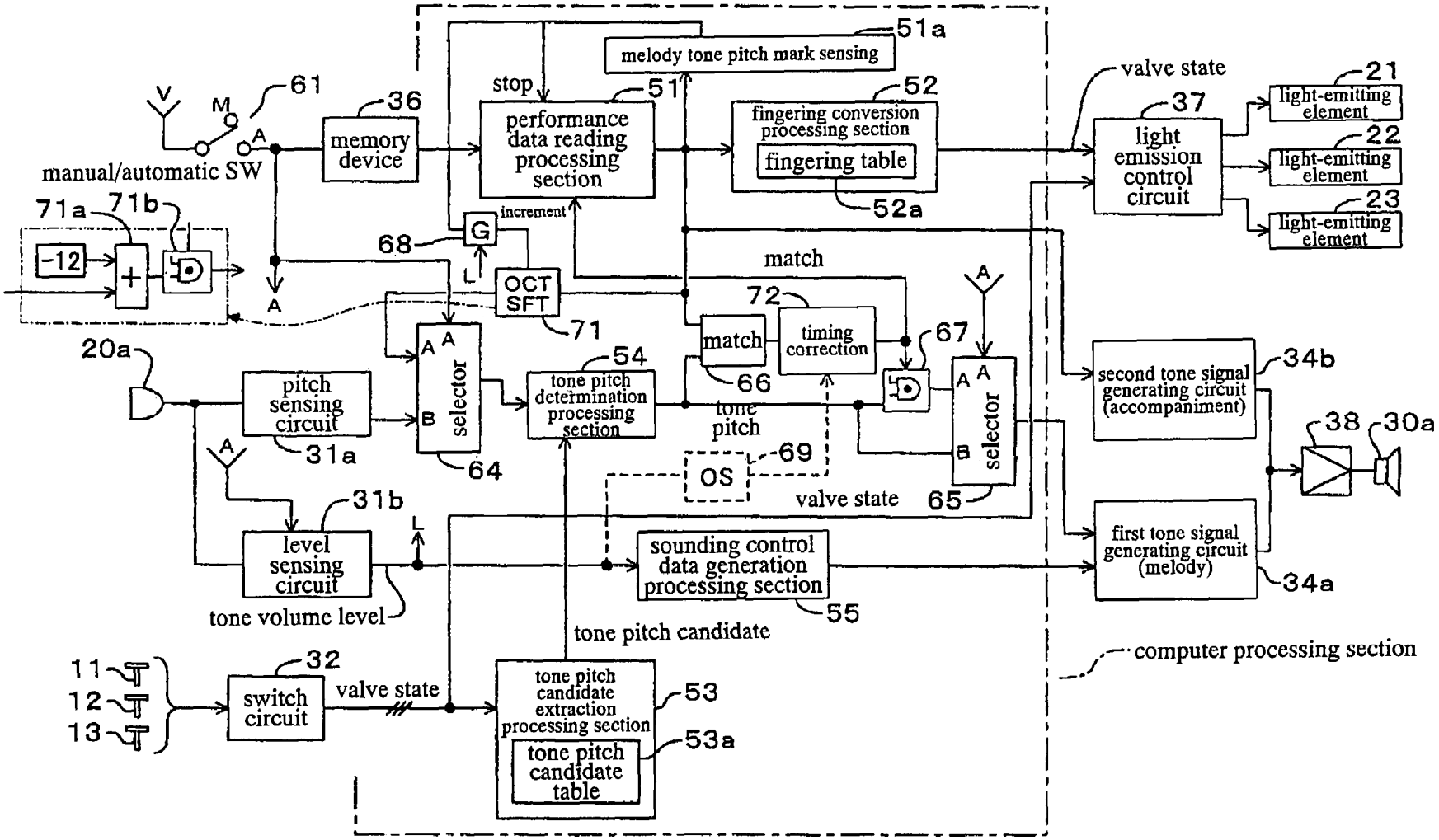
FIG. 5 is a functional block diagram according to the embodiment of the present invention.

As shown by a leader line in FIG. 5, the octave shift circuit 71 adds, at an addition circuit 71*a*, "−12" (to shift an octave lower) to melody tone pitch data (key code) transmitted from the performance data reading processing section 51, and outputs the tone pitch data which is shifted an octave lower from an AND circuit 71*b* to which a gate signal is input. The tone pitch data is then input to the tone pitch determination processing section 54 as a pitch data via the selector 64. Since the present embodiment is configured such that the tone pitch determination processing section 54 determines a tone pitch on the basis of tone pitch candidates ("determined tone pitch" that is an octave higher than a human (male) voice range) and a voice pitch (a tone pitch that is an octave lower), the processing of the octave-shift is provided in order to adapt melody tone pitch data to a voice pitch.

In the same manner as the manual mode, an operated state of the first to third valve operators 11 to 13 are sensed by the switch circuit 32. The switch circuit 32 then inputs a valve state signal to the tone pitch candidate extraction processing section 53. The tone pitch candidate extraction processing section 53 extracts sets of tone pitch candidate data corresponding to the valve state signal from the tone pitch candidate table 53*a* and outputs the sets of tone pitch candidate data to the tone pitch determination processing section 54. The tone pitch determination processing section 54 extracts, from the sets of tone pitch candidate data, a set of tone pitch data corresponding to input pitch data, and outputs the extracted tone pitch data to the match sensing circuit 66 and gate circuit 67. When the tone pitch data determined at the tone pitch determination processing section 54 matches with the melody tone pitch data output from the performance data reading processing section 51, the match sensing circuit 66 outputs a match signal to a timing correction circuit 72.

The timing correction circuit 72 immediately outputs the match signal transmitted from the match sensing circuit 66 to the gate circuit 67. The match signal allows the gate circuit 67 to output the tone pitch data transmitted from the tone pitch determination processing section 54 to the first tone signal generating circuit 34*a* via the selector circuit 65. In the same manner as the manual mode, therefore, the first tone signal generating circuit 34*a* generates a musical tone signal corresponding to a melody tone defined on the basis of the operated state of the valve operators 11 to 13 and the pitch data corresponding to the melody tone pitch data read out from the performance data reading processing section 51. The tone volume, tone color, etc. of the musical tone signal are controlled, in the same manner as the manual mode, in accordance with sounding control data generated by the sounding control data generation processing section 55 on the basis of the tone volume level sensed by the level sensing circuit 31*b*.

The timing correction circuit 72 is originally designed to control the performance data reading processing section 51 to delay the timing for reading performance data so that the generation of the melody tone signal precedes the reading of performance data. In the present embodiment, in order to read subsequent melody tone pitch data at the completion of the generation of the melody tone signal, the timing correction circuit 72 controls the increment of the performance data reading processing section 51 when the match signal is completed (when the match signal is turned from high-level to low-level). Due to the timing correction circuit 72, if among sets of tone pitch candidate data extracted in accordance with a valve state signal based on the operation of the first to third valve operators 11 to 13, a tone pitch determined in accordance with pitch data corresponding to melody tone pitch data read out by the performance data reading processing section 51 matches with a tone pitch represented by the read-out melody tone pitch data, the musical instrument is allowed to generate a melody tone signal corresponding to the matched tone pitch. Upon completion of the generation of the melody tone signal, the performance data reading processing section 51 reads subsequent melody tone data. The above-described capability of the timing correction circuit 72 and the maintained high-level state of the gate circuit 68 resulting from the input of data L of the tone volume level enable a player to play on the musical instrument in an appropriate rhythm defined by himself/herself.

The above-described timing correction may be replaced with the following method: as shown by a broken line in FIG. 5, the timing correction circuit 72 may correct the timing of the increment by inputting data L of the tone volume level output from the level sensing circuit 31*b* to the one-shot circuit 69 and receiving an output signal from the one-shot circuit 69 for use on the correction. In this case, the one-shot circuit 69 switches an output signal from low-level to high-level when data L has a tone volume level equal to or higher than a predetermined level. As long as the data L maintains a tone volume level equal to or higher than a predetermined level, the one-shot circuit 69 keeps its output signal in high-level. When the tone volume level of data L is decreased below a predetermined level, on the other hand, the one-shot circuit 69 switches its output signal from high-level to low-level in a given short period of time. In this modification, after the timing correction circuit 72 inputs a match signal from the match sensing circuit 66 and controls the generation of a melody tone signal, the timing correction circuit 72 outputs a control signal for use on the increment at the performance data reading processing section 51 on the condition that an output signal of the one-shot circuit 69 has been switched from high-level to low-level.

In this modified example as well, melody tone data of the memory device 36 is read in accordance with data input by a player to the vibration sensor 20*a* at the completion of the generation of a melody tone signal. As a result, the player is allowed to play on the musical instrument in an appropriate rhythm defined by himself/herself. In this case, if the assumption is made that the player appropriately operates the valve operators 11 to 13 in a short period of time in accordance with the indication given by the light-emitting elements 21 to 23, the gate circuit 68 does not require the above-described re-triggering operation of the one-shot circuit in accordance with data L of the tone volume level output from the level sensing circuit 31*b*. In other words, the one-shot circuit incorporated into the gate circuit 68 starts outputting a signal in high-level at the input of a stop signal from the melody tone pitch mark sensing section 51*a*, and then switches the output signal to low-level after a predetermined period of time has elapsed. While the output signal is kept in high-level, the tone pitch determination processing section 54 keeps outputting melody tone pitch data. If the player appropriately operates the valve operators 11 to 13 during this while, the match sensing circuit 66 outputs a match signal, so that the first tone signal generating circuit 34*a* receives tone pitch data for a melody tone. As a result, the generation of a melody tone signal can be controlled.

In the automatic mode, as described above, pitch data corresponding to a voice pitch is automatically generated on the basis of melody tone pitch data contained in automatic performance data, while a valve state signal is obtained on the basis of the operation of the valve operators 11 to 13. When a tone pitch that matches the melody tone pitch of the automatic performance data is determined on the basis of the valve state signal and the automatically generated pitch data, the electronic musical instrument proceeds with the performance of the melody. Further, a combination of the valve operators 11 to 13 that should be operated in associated relation with melody tone pitch data is indicated through the energization of the light-emitting elements 21 to 23 in corresponding relation with the valve operators 11 to 13. When a voice or breath is input to the vibration sensor 20*a*, sounding control data that includes a tone volume parameter, tone color parameter, and the like is output to the first tone signal generating circuit 34*a* by the level sensing circuit 31*b* and the sounding control data generation processing section 55. Therefore, the electronic musical instrument can also control musical tones on the basis of the sounding control data.

The above-described embodiment is designed such that an instruction to stop the performance made after the increment of the memory address is given at the detection of subsequent melody tone pitch data (or melody tone pitch mark), however, the above embodiment may be adapted to give the instruction to stop the performance after the detection of subsequent timing data (time) or note length data (time interval), or the detection of a mark thereof. Besides note data such as subsequent melody tone pitch data, the instruction may by given at every given length of performance (or a length determined on the basis of some rule) divided by the unit of phrase, bar, etc. or at every rest. That is, the intervals between the increment and suspension of the performance in the present invention are not necessarily divided by the unit of a note such as the case of the above-described embodiment, but may be divided by the above-described units. Furthermore, the intervals may be divided by other units. In addition, it is needless to say that the format of performance data that is applicable to the present invention is not limited to the one employed in the embodiment (FIG. 6) but may be other different formats.

As the embodiment, the electronic musical instrument may further include a performance instructing section in order to give an instruction by energization (an instruction by vibration is also applicable) through the use of information on an operated state of operators contained in performance data transmitted from the ancillary performance section to help a player proceed with the performance. Due to the performance instructing section, the player can learn the fingering required at each step (each note) of the performance.

As the embodiment, furthermore, the electronic musical instrument may assist the performance through the use of musical piece data storing means for storing data on musical pieces as a source of the ancillary performance section and reading means for sequentially reading musical piece data stored in the music piece data storing means.

Shown in the above embodiment is an example in which the configuration for inputting automatic performance data from the memory device 36 is adopted as "ancillary performance section" or "automatic performance section" for inputting performance data, however, the "ancillary performance section" is not limited to this example. For instance, performance data performed by a professional player or skilled player may be input to the "ancillary performance section". Alternatively, the "ancillary performance section" may receive performance data from a server on the Internet.

Further, in the above-described embodiment, the operators to be operated among the first to third valve operators 11 to 13 are visually displayed by energization of the light-emitting elements 21 to 23. However, instead of this or in addition to this, the valve operators to be operated may be a little displaced upwards or downwards, or the valve operators may be vibrated so as to give fingering guide such that the valve operators to be operated may be recognized by the player through his/her skin sensation. In this case, as shown by broken lines in FIG. 2, driving devices 81 to 83 such as a small electromagnetic actuator or a small piezoelectric actuator that drive the first to third valve operators 11 to 13 may be incorporated in the grasping section 50 and, instead of or in addition to the light emission control circuit 37, a driving control circuit may be disposed that controls driving of the aforesaid driving devices 81 to 83 on the basis of the valve state signal representing the valve operators to be operated.

In addition, as the embodiment shown by a broken line in FIG. 5, the musical instrument may use level data input from the oral input section as the assistance of the increment in order to prevent cases where the player is disturbed by frequent suspension of the performance.

Furthermore, described in the above embodiment is a case of a trumpet-shaped musical instrument, however, the present invention may be applied to wind instrument-shaped electronic musical instruments which imitate a wind instrument which has a plurality of performance operators and determines a tone pitch of a musical tone to be generated on the basis of a combination of operated performance operators.

Further, described in the above embodiment is a case where a vibration sensor such as a microphone is used as means for inputting a voice pitch, however, a bone conduction pick-up device that senses vibration by being allowed to touch the "throat" of a human body may be used. By use of such device, the present invention paves the way to enable those having bad vocal cords to play a mouth air stream type musical instrument.

What is claimed is:

1. A musical instrument having a plurality of performance operators and an oral input section for inputting a signal containing pitch information related to a pitch generated by a mouth, the musical instrument comprising:

an ancillary performance section for sequentially outputting first performance data representative of a tone pitch of a musical tone;

a pitch data generating section for generating pitch data corresponding to a tone pitch represented by the first performance data sequentially output from the ancillary performance section; and a tone pitch determination section for determining in a first playing mode a tone pitch of a musical tone that should be generated solely on the basis of the pitch represented by the generated pitch data and a combination of operation of the plurality of performance operators, regardless of any signal input to the oral input section.

2. A musical instrument according to claim 1, wherein the plurality of performance operators are operated with a hand.

3. A musical instrument according to claim 1, further comprising a performance guiding section for showing a user a combination of the plurality of performance operators that should be operated by use of performance data output from the ancillary performance section.

4. A musical instrument according to claim 3, wherein the performance guiding section includes a plurality of light emitting devices for showing a user the performance operators that should be operated by light emission of a neighborhood of each of the plurality of performance operators.

5. A musical instrument according to claim 1, further comprising a performance data update control section for determining whether the tone pitch determined by the tone pitch determination section matches the tone pitch represented by the first performance data output from the ancillary performance section, and controlling, in accordance with the determined result, an update of the performance data output from the ancillary performance section.

6. A musical instrument according to claim 1, wherein the ancillary performance section outputs second performance data that is different from the first performance data in interlocked relation with the first performance data and generating a musical tone corresponding to the second performance data.

7. A musical instrument according to claim 6, wherein the first performance data represents a melody tone, while the second performance data represents an accompaniment tone.

8. A musical instrument according to claim 1, wherein:

the ancillary performance section outputs second performance data that is different from the first performance data in interlocked relation with the first performance data and generating a musical tone corresponding to the second performance data; and the musical instrument further comprises a performance data update control section for determining whether the tone pitch determined by the tone pitch determination section matches the tone pitch represented by the first performance data output from the ancillary performance section, and controlling, in accordance with the determined result, an update of the second performance data output from the ancillary performance section.

9. A musical instrument according to claim 1, wherein:

the ancillary performance section has a capability of outputting second performance data that is different from the first performance data in interlocked relation with the first performance data and generating a musical tone corresponding to the second performance data; and the musical instrument further comprises a performance data update control section for determining whether the tone pitch determined by the tone pitch determination section matches the tone pitch represented by the first performance data output from the ancillary performance section, and controlling, in accordance with the determined result, an update of the first performance data and the second performance data output from the ancillary performance section.

10. A musical instrument according to claim 1, wherein the first playing mode is an automatic mode.

11. An electronic musical apparatus comprising:

an oral input section for inputting a voice signal generated by a mouth:

a voice signal input circuit coupled to receive the voice signal from the oral input section, wherein the voice signal input circuit includes a level sensing circuit for sensing an input tone volume level of the oral input signal;

a plurality of performance operators;

a switching circuit coupled to the performance operators for outputting a performance operator state signal in response to operation of the performance operators;

a memory for storing performance data representative of a musical tone, wherein said performance data includes tone pitch data corresponding to the musical tone;

a processing section coupled to receive the input tone volume level, the performance operator state signal, and the performance data, and to selectively generate an output tone pitch signal, wherein the processing section includes:

a performance data reading and processing section that reads the performance data, while incrementing the tone pitch data contained in the performance data;

means for generating voice pitch data corresponding to the tone pitch data from the performance data stored in the memory;

a tone pitch candidate extraction processing section that extracts tone pitch candidates from the performance operator state signal; and a tone pitch determination processing section that determines in a first playing mode the output tone pitch signal solely based on the generated voice pitch data and the extracted tone pitch candidates.

12. An electronic musical apparatus as claimed in claim 11, wherein the output tone pitch signal represents a melody tone.

13. An electronic musical apparatus as claimed in claim 12, wherein the performance data includes accompaniment tone pitch data, and wherein the processing section outputs the output tone pitch signal to a melody tone signal generating circuit and outputs the accompaniment tone pitch data to an accompaniment tone signal generating circuit.

14. An electronic musical apparatus as claimed in claim 11, further comprising a matching circuit that determines if the output tone pitch signal corresponds to the tone pitch data from the performance data and controls the incrementing of the tone pitch data by the performance data reading and processing section in accordance with the determined result.

15. An electronic musical apparatus as claimed in claim 11, wherein the voice signal input circuit further includes a pitch sensing circuit for sensing an input voice pitch from the input voice signal and outputting an input voice pitch signal, and the processing section supplies the input voice pitch signal to the tone pitch determination processing section in a second playing mode, and wherein the tone pitch determination processing section generates the output tone pitch signal based on the input voice pitch signal and the performance operator state signal in the second playing mode.

16. An electronic musical apparatus as claimed in claim 15, wherein the processing section supplies the input tone volume level to a sounding control data generation processing section in the second playing mode.

17. An electronic musical apparatus as claimed in claim 15, wherein the second playing mode is a manual mode.

18. An electronic musical apparatus as claimed in claim 11, wherein the first playing mode is an automatic mode.

* * * * *